United States Patent [19]

Moss

[11] 4,231,582

[45] Nov. 4, 1980

[54] FOLDABLE ROUND BOUNCER/WALKER

[75] Inventor: Mark D. Moss, Hollidaysburg, Pa.

[73] Assignee: Hedstrom Co., Bedford, Pa.

[21] Appl. No.: 941,242

[22] Filed: Sep. 11, 1978

[51] Int. Cl.[3] ..... B62D 7/10

[52] U.S. Cl. ..... 280/87.02 W; 272/70.3; 280/7.1; 280/87.03; 280/87.05; 280/650; 297/5

[58] Field of Search ..... 280/87.02 W, 87.05, 280/87.03, 7.1, 650, 649, 648, 647; 297/5, 6; 272/70.3, 70, 70.4; 267/74

[56] References Cited

U.S. PATENT DOCUMENTS

| | | | |
|---|---|---|---|
| 2,820,269 | 1/1958 | Wollf | 267/74 X |
| 3,194,577 | 7/1965 | Berlin | 297/5 |
| 4,045,045 | 8/1977 | Boucher et al. | 280/87.02 W |

*Primary Examiner*—John J. Love
*Assistant Examiner*—Milton L. Smith
*Attorney, Agent, or Firm*—Cesari and McKenna

[57] ABSTRACT

A play seat includes telescoping scissor frames for supporting a seat above a base ring composed of two opposing arcuate ring sections whose opposite ends are connected together by stiff coil springs. The lower ends of the scissor frames are pivotally connected to the ring sections so that any weight in the seat tends to spread apart the ring sections thereby tensioning the springs whereby the seat is resiliently supported above the ground. Each spring is protectively enclosed within a plastic sleeve.

3 Claims, 2 Drawing Figures

FOLDABLE ROUND BOUNCER/WALKER

This invention relates to juvenile furniture. It relates more particularly to a foldable infant's walker/bouncer having a round or ring-type base.

BACKGROUND OF THE INVENTION

There are numerous different types of children's walkers and bouncers some of which have annular or ring-type bases as depicted in U.S. Pat. No. 4,045,045 owned by the assignee of the present application.

One problem with bouncers and walkers of that general type is the difficulty in storing them because the ring-type base is fairly large in the order of three feet in diameter and the seat projects two to three feet above the ring. Also, if the prior unit has a bouncing capability, it tends to be relatively expensive because the springs that give the unit its resiliency are mounted inside the scissor-type frames that suspend the seat above the base ring.

SUMMARY OF THE INVENTION

Accordingly, the present invention aims to provide a round or ring-type child's walker which can be stored in a minimum amount of space.

A further object of the invention is to provide an improved walker of that type having a bouncing capability.

Yet another object of the invention is to provide a ring-type walker/bouncer which is relatively easy and inexpensive to make.

A further object of the invention is to provide a bouncer of that general type which has a minimum number of pinch points.

Other objects will in part be obvious and will in part appear hereinafter.

The invention accordingly comprises the features of construction, combination of elements and arrangement of parts as will be eximplified in the following detailed description, the scope of the invention which will be indicated in the claims.

In general, a bag type child-supporting seat is suspended above the ground on scissor frames whose lower ends are supported by a ring mounted on casters. The ring is composed of two halves which are connected together by stiff coil springs. The walker achieves its bouncing capability by virtue of the fact that the two members comprising each scissor frame are pivotally connected to opposite halves of the ring so that downward forces on the seat tend to spread apart the scissor frames whereby the ring halves are also spread apart in opposition to the bias afforded by the interconnecting springs. One member of each scissor frame telescopes to permit the seat to be folded down flush against the ring to facilitate storage. Also the springs are covered by fairly heavy plastic sleeves so that they do not provide pinch points.

BRIEF DESCRIPTION OF THE DRAWING

For a fuller understanding of the nature and objects of the invention, reference should be had to the following detailed description taken in connection with the accompanying drawing in which.

DESCRIPTION OF THE PREFERRED EMBODIMENT

Figure 1:
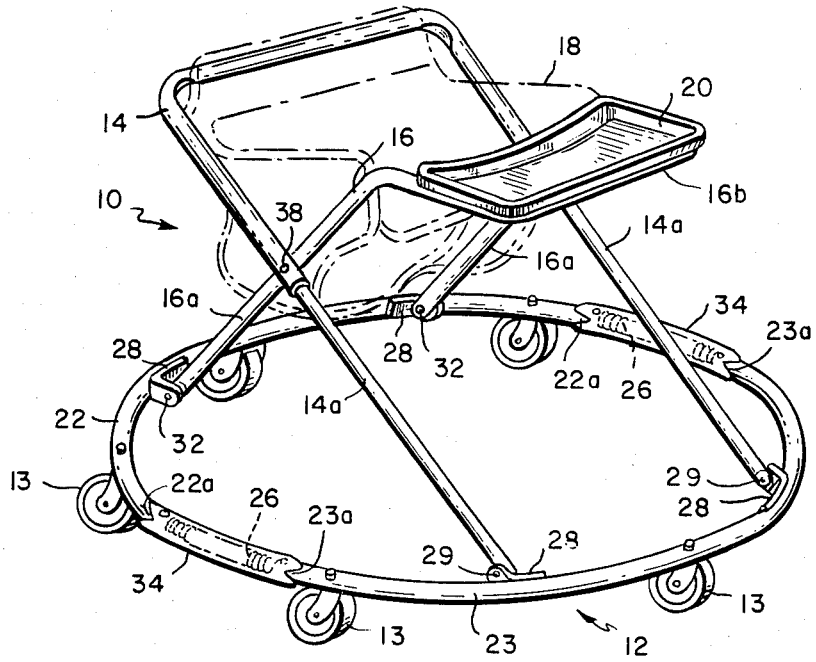
FIG. 1 is a perspective view of a child's walker/-bouncer made in accordance with this invention.

Referring to FIG. 1 of the drawing, the walker/-bouncer comprises an upstanding child-supporting seat assembly indicated generally at 10 supported by a ring-type base shown generally at 12 outfitted with casters 13.

The seat assembly includes a part of generally U-shaped mambers 14 and 16, whose opposite arms 14*a* and 16*a* are pivoted to form a pair of laterally spaced scissor frames. The members 14 and 16 support a bag-type seat shown in phantom at 18 and the bridging end 16*b* of frame member 16 is bent forwardly to form a horizontal frame for a tray 20.

Figure 2:
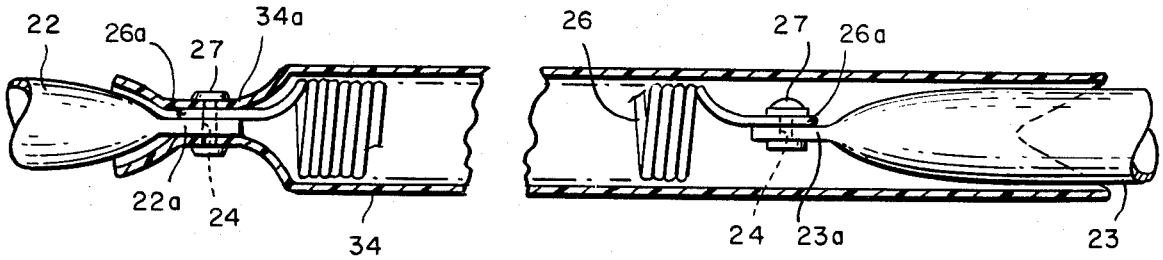
FIG. 2 is a fragmentary elevational view on a larger scale of a portion of the FIG. 1 walker.

The base ring 12 comprises a rear half section 22 and a half front section 23, the ends 22*a* and 23*a* of these two sections being flattened and provided with openings 24. A relatively stiff coil spring 26 is provided at each side of the base 12 between the two sections 22 and 23. As best seen in FIG. 2, the opposite ends 26*a* of each spring are secured to section ends 22*a* and 23*a* by rivets 27 pressed into the openings 24 in those ends. Alternatively, the opposite ends of the springs may be hooked into openings 24.

Referring now to FIG. 1, a pair of brackets 28 are welded or riveted to each ring section 22 and 23 at spaced apart locations on the inside of the ring section. The lower ends of the frame arms 14*a* are flattened and connected to the brackets 28 on ring section 23 by pivot pins 29. Likewise, the lower ends of frame arms 16*a* are pivotally connected to the brackets 28 on the ring section 22 by pivot pins 32.

When a child is placed in the seat 18, the child's weight tends to spread apart the lower ends of frame arms 14*a* and 16*a* which, in turn, tends to spread apart the ring sections 22 and 23, thereby tensioning the springs 26. Furthermore, vertical bouncing movements of the child in the seat 28 are resiliently opposed by the springs 26 which thereby reinforce the child's bouncing movements.

As best seen in FIG. 2, in order to prevent the child's fingers from being pinched by the springs 26, a plastic sleeve 34 covers each spring. One end 34*a* of each sleeve is secured to the end of a ring section, say, section 22, by the rivet 27 thereon, the other end of the sleeve being left free so that the spring is able to extend and contract inside the sleeve to accomodate the bouncing movements of the child.

To facilitate storing the walker in a minimum amount of space, the arms of one of the frame members 14, 16, say arms 14*a* are made to telescope and are provided with the usual spring-loaded locking pins 38 to maintain the telescoping arm sections in their extended positions when the walker is in use. When it is desired to store the unit, the pins may be released allowing the arm 14*a* sections to telescope so that the seat assembly 10 folds down flat against the ring 12.

It will thus be seen that the objects set forth above, among those made apparent from the preceeding description, are efficiently attained and since certain chances may be made in the above construction without departing substantially from the invention, it is intended that all matter contained in the above description or shown in the accompanying drawing be interpretated as illustrative and not in a limiting sense.

It will also be understood that the following claims are intended to cover all of the generic and specific features of the invention herein described.

I claim:

1. A child's play seat of the type which includes a pair of scissor frames and a seat supported by the scissor frames, the improvement comprising a pair of arcuate base frame sections the opposite ends of which are positioned opposite one another, a pair of coil springs connected to the opposing ends of the two base frame sections to form a base ring and means for pivotally connecting the lower ends of the scissors frames to the base frame sections so that a weight in the seat tends to spread apart the lower ends of the scissor frames thereby spreading apart the base frame sections and tensioning the springs so that the seat is resiliently supported above the ground and wherein said corresponding scissor frames comprise telescoping sections permitting the scissor frames and seat to fold down against the base ring, and means for releasably securing the telescoping sections in their extended positions.

2. The play seat defined in claim 1 and further including casters mounted on the base frame sections.

3. The play seat seat defined in claim 1 and further including a plastic sleeve covering each spring and means for securing one end of the sleeve adjacant one end of the underlying spring so that the sleeve is secured in place yet permits extension for the spring.

* * * * *

UNITED STATES PATENT AND TRADEMARK OFFICE

CERTIFICATE OF CORRECTION

PATENT NO. : 4,231,582

DATED : November 4, 1980

INVENTOR(S) : Mark D. Moss

It is certified that error appears in the above-identified patent and that said Letters Patent are hereby corrected as shown below:

Col. 1, Line 40, "eximplified" should be --exemplified--.

Col. 2, Line 9, "part" should be --pair--.

Col. 2, Line 10, "mambers" should be --members--.

Col. 2, Line 49, "accomodate" should be --accommodate--.

Col. 2, Line 64, "chances" should be --changes--.

Col. 2, Line 67, "interpretated" should be --interpreted--.

Col. 4, Line 12, "adjacant" should be --adjacent--.

Col. 4, Line 14, "for" should be --of--.

Signed and Sealed this

*Third* Day of *March 1981*

[SEAL]

*Attest:*

RENE D. TEGTMEYER

*Attesting Officer*

*Acting Commissioner of Patents and Trademarks*